US006484706B1

(12) United States Patent
Mate

(10) Patent No.: US 6,484,706 B1
(45) Date of Patent: Nov. 26, 2002

(54) NONADJUSTABLE THROTTLE LINKAGE AND INTERNAL COMBUSTION ENGINE EMPLOYING SAME

(75) Inventor: David W. Mate, McHenry, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/570,642

(22) Filed: May 15, 2000

(51) Int. Cl.[7] ..... F02D 9/10
(52) U.S. Cl. ..... 123/583
(58) Field of Search ..... 123/583

(56) References Cited

U.S. PATENT DOCUMENTS

| | | | | |
|---|---|---|---|---|
| 4,062,334 A | * | 12/1977 | Toda et al. | 123/583 |
| 4,239,710 A | | 12/1980 | Sato | |
| 4,317,784 A | | 3/1982 | Kato et al. | |
| 4,577,608 A | * | 3/1986 | DuBois et al. | 123/583 |
| 4,823,748 A | * | 4/1989 | Ampferer et al. | 123/583 |
| 4,943,141 A | | 7/1990 | Mori | |
| 4,971,006 A | * | 11/1990 | Imaeda | 123/583 |
| 4,995,370 A | | 2/1991 | Imaeda et al. | |
| 5,022,736 A | | 6/1991 | Mori | |
| 5,517,963 A | * | 5/1996 | Yoshida et al. | 123/583 |
| 5,517,977 A | * | 5/1996 | Nakai et al. | 123/583 |
| 5,729,387 A | | 3/1998 | Takahashi et al. | |
| 5,803,044 A | * | 9/1998 | Kato | 123/583 |
| 5,921,225 A | * | 7/1999 | Nakamura | 123/583 |

FOREIGN PATENT DOCUMENTS

| | | |
|---|---|---|
| CN | 95107312.5 | 3/1996 |
| EP | 0 628 713 A1 | 12/1994 |
| JP | 5-205871 | 2/1995 |

* cited by examiner

*Primary Examiner*—Marguerite McMahon
*Assistant Examiner*—Jason Benton
(74) *Attorney, Agent, or Firm*—Timothy J. Ziolkowski

(57) ABSTRACT

A throttle linkage for an internal combustion engine includes a lever assembly that is configured to connect an operator-manipulated input element to an output element that controls at least a throttle of the engine. At least one stop pin is mounted on the lever assembly and is configured to engage a stationary seat when the lever assembly is in one of a full-open position and an idle position. The stop pin is axially locked with respect to the lever assembly so as to be axially nonadjustable relative to it. If the stop pin is screwed into the lever assembly, a head of the stop pin preferably faces the associated stationary seat so as to be relatively inaccessible after the throttle linkage is mounted on the engine. The head may also be covered by a cap to further hinder tampering with the stop pin. As a result of this arrangement, the operating stroke of the lever assembly is preset upon initial assembly of the lever assembly and cannot be adjusted. This relationship significantly accelerates engine assembly and prevents tampering with the lever assembly by the operator after the engine is assembled. It also prevents the stop pin from working loose during engine operation, negating the need to adjust the stop pin's position.

36 Claims, 4 Drawing Sheets

FIG. 2A
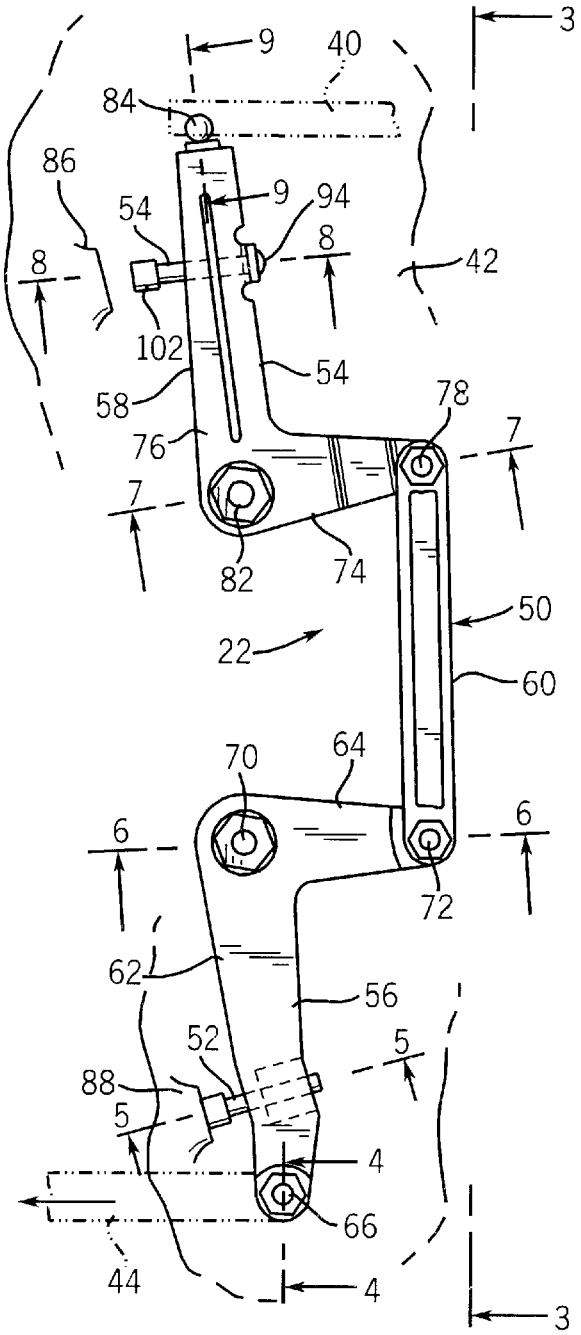
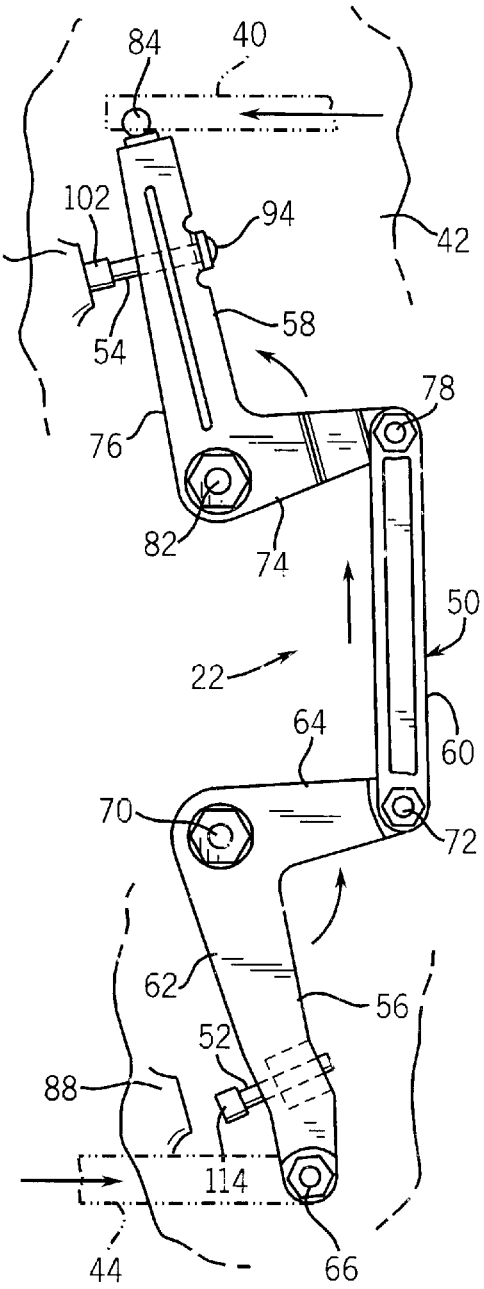
FIG. 2B

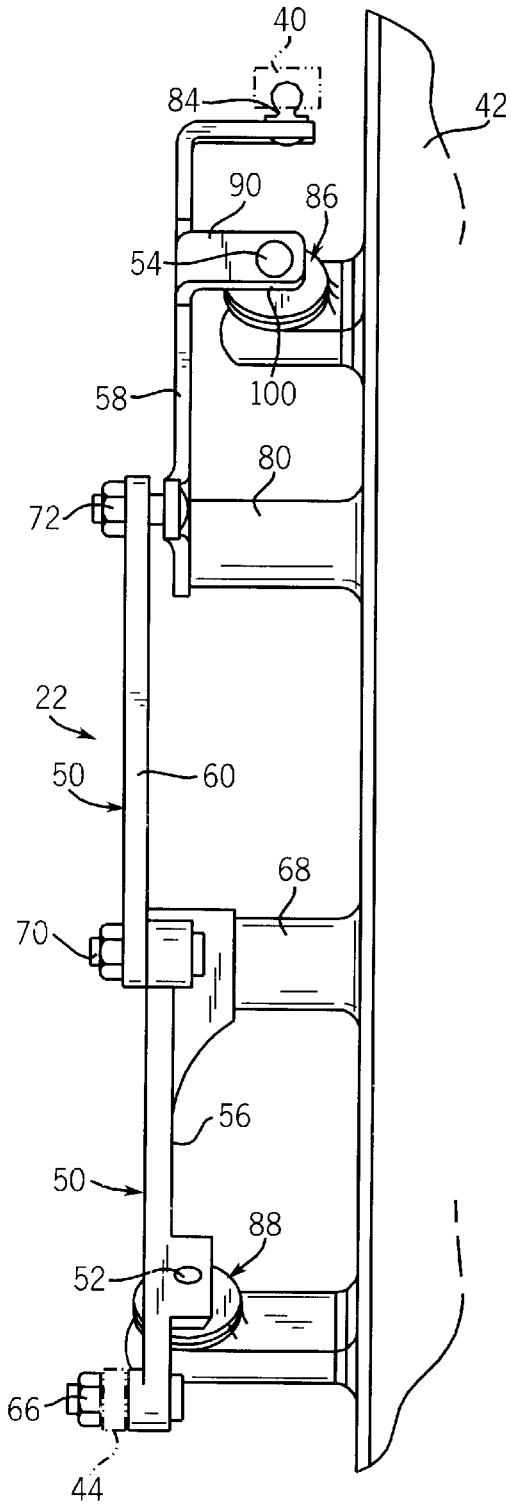
FIG. 3
FIG. 9
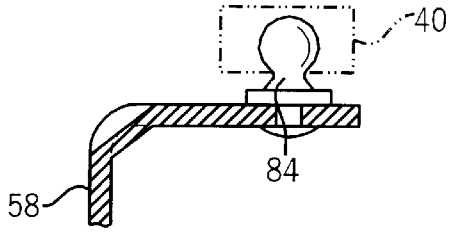
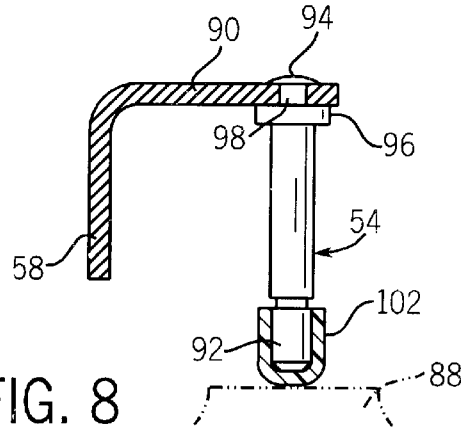
FIG. 8
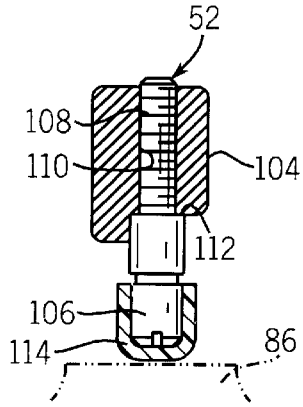
FIG. 5
FIG. 4
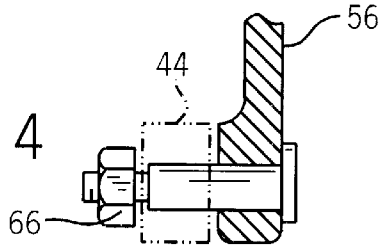

NONADJUSTABLE THROTTLE LINKAGE AND INTERNAL COMBUSTION ENGINE EMPLOYING SAME

BACKGROUND OF THE INVENTION

The invention relates generally to internal combustion engines and, more particularly, relates to an engine having a nonadjustable throttle linkage and to a nonadjustable throttle linkage usable on such an engine. The invention additionally relates to a method of mounting a nonadjustable throttle linkage on an engine.

Most engines employ a throttle to modulate airflow to the engine's air intake valve(s) and possibly to advance ignition timing on demand. In the case of a carbureted engine, the throttle usually varies the position of a carburetor's butterfly valve. In the case of a fuel injected system, each cylinder may have a dedicated throttle plate that can be pivoted to control airflow to the air intake valve(s) of that cylinder. All of the throttle plates of a particular row of cylinders of this type of engine are pivoted via a common throttle shaft that connects the throttle plates to one another. Hence, a V-6 or V-8 engine contains two throttle shafts, each of which controls the throttle plates of three or four cylinders. The throttle shafts are interconnected so as to rotate simultaneously and commensurately with one another. The throttle shafts are rotated by a throttle linkage that is connected to the throttle shafts via an output element for the throttle linkage. The throttle linkage includes a lever assembly that is connected to the output element and to an input element that is actuated either directly or indirectly by the engine's operator.

Some throttle linkages include an idle stop and/or a fall-open stop to limit the operating range of the linkage's lever assembly and, therefore, the engine operating speed range. In one configuration having both an idle stop and a full-open stop, both stops include a stop screw threaded into a throttle lever of the lever assembly. A head or jam nut of each stop screw engages a stationary seat when the throttle lever assembly is in the relevant position. The spacing of the jam nuts from the lever assembly can be varied to set and/or adjust the idle position and the fall-open position of the lever assembly.

The ability to vary the position of the jam nut of the stop screw of the throttle linkage relative to the linkage's lever assembly produces marked drawbacks. For instance, the idle stop screw and full-open stop screw must be set upon initial assembly of each engine using a somewhat complex procedure that accompanies a throttle plate synchronization procedure. Specifically, after the throttle linkage is mounted on the engine and initially linked to the throttle shafts via the output element, the positions of both the idle stop screw and the full-open stop screw must be adjusted to assure that a cam roller of the output element rolls freely along the associated cam follower throughout the full range of lever assembly movement. This setting operation is usually an iterative process, considerably lengthening the time required to assemble an engine and running the risk of improper setting.

Settable or adjustable idle and wide-open stop screws are also prone to tampering by the engine's operator. This tampering risks jamming or damage to some components of the throttle linkage if either stop screw is moved beyond a position in which the cam roller of the output element rides freely. Positioning either stop screw at a location other than the manufacturer's recommended position also risks degraded engine performance and elevated emission levels.

These problems are especially acute with respect to fuel injected outboard marine engines, which are subject to relatively onerous performance and emission requirements and which are often operated by individuals who like to tinker with the engine in an attempt to obtain a perceived enhanced performance.

Another problem associated with adjustable stops is that, if they are configured to be easily adjustable, they often tend to work loose from their preset positions due to vibrations resulting from engine operation. Their positions therefore must be periodically adjusted.

The need therefore has arisen to provide a throttle linkage for an engine, such as a fuel-injected outboard marine engine, that is not adjustable.

SUMMARY OF THE INVENTION

In accordance with a first aspect of the invention, a throttle linkage is provided that includes a lever assembly that is configured to connect an operator-manipulated input element to an output element that controls a throttle and possibly other components of the engine. The lever assembly typically includes at least two throttle levers, possibly coupled to one another by one or more links. At least one stop pin is mounted on the lever assembly and is configured to engage a stationary seat when the lever assembly is in one of a fall-open position and an idle position. One throttle linkage constructed in accordance with the invention has two stop pins, one of which engages an associated stationary seat when the lever assembly is in its full-open position, and the other of which engages an associated stationary seat when the lever assembly is in its idle position. The stop pins are axially locked with respect to the lever assembly so as to be axially nonadjustable relative to it. As a result of this arrangement, the operating stroke of the lever assembly is preset upon initial assembly of the throttle linkage and cannot be adjusted. This relationship significantly accelerates engine assembly and prevents tampering with the throttle linkage by the operator after the engine is assembled. It also prevents the stop pins from working loose during engine operation, negating the need to adjust the stop pins' positions.

Several techniques are available for axially locking a stop pin in position on the lever assembly. For instance, the stop pin could be swaged onto the associated component of the lever assembly. Alternatively, it could be screwed into the associated lever assembly component to a position in which a shoulder or other surface on the stop pin engages a lug or other seat on the lever assembly. In this case, measures are preferably taken to prevent or at least discourage post-assembly unscrewing of the stop pin from the associated component of the lever assembly. For instance, a cap could cover the head of the stop pin. A chemical locking agent could also be applied to the threads of the stop pin to inhibit the stop pin from unscrewing from the lever assembly due to vibrations imposed on the throttle linkage during engine operation. Tampering with a threaded stop pin could also be discouraged by threading the stop pin into the associated component of the lever assembly from the side that faces the associated stationary seat, thus preventing access to the head of the stop pin by a tool without removing the throttle linkage from the engine.

In accordance with another aspect of the invention, an internal combustion engine is provided that incorporates a nonadjustable throttle linkage of the type having at least some of the characteristics of the throttle linkage described above. In an application, such as an outboard marine engine, in which the engine extends vertically, the throttle linkage extends vertically along the side of the engine. An outboard marine engine presents a particularly beneficial application of the inventive throttle linkage because outboard marine engines are subject to rigid emission and performance standards and rather severe vibrations.

In accordance with yet another aspect of the invention, a simplified method is provided for mounting a throttle linkage on an internal combustion engine so as to facilitate engine assembly and to prevent post-assembly tampering with the throttle linkage. The method includes mounting at least one stop pin on a lever assembly so as to prevent subsequent axial adjustment of the stop pin relative to the lever assembly. Then, the lever assembly is mounted on the engine so that the stop pin faces a stationary seat on the engine so as to engage that stationary seat when the lever assembly is pivoted into one of its idle and full-open positions.

The stop pin may be mounted on the lever assembly by turning a head of the stop pin with a tool to screw a threaded portion of the stop pin into a correspondingly threaded portion of the lever assembly. Due to the orientation of the throttle linkage on the engine, the head of the stop pin faces and is adjacent to the stationary seat, thereby preventing or at least inhibiting access to the head of the stop pin by the tool. A cap may also be mounted over the head of the stop pin both to protect the stop pin and stationary seat and to further discourage tampering with the stop pin. Alternatively, the stop pin could be swaged onto the associated component of the lever assembly.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which:

FIGS. 2*a* and 2*b* are fragmentary elevation views of the throttle linkage of FIG. 1, illustrating the throttle linkage in idle and full-open positions thereof, respectively;

FIG. 3 is a fragmentary sectional view taken generally along the lines 3—3 in FIG. 2*a;*

FIG. 4 is a fragmentary sectional view taken generally along the lines 4—4 in FIG. 2*a;*

FIG. 5 is a fragmentary sectional view taken generally along the lines 5—5 in FIG. 2*a;*

FIG. 8 is a fragmentary sectional view taken generally along the lines 8—8 in FIG. 2*a; and*

FIG. 9 is a sectional view taken generally along the lines 9—9 in FIG. 2*a.*

DETAILED DESCRIPTION OF THE PREFERRED EMBODIMENT

Figure 1:
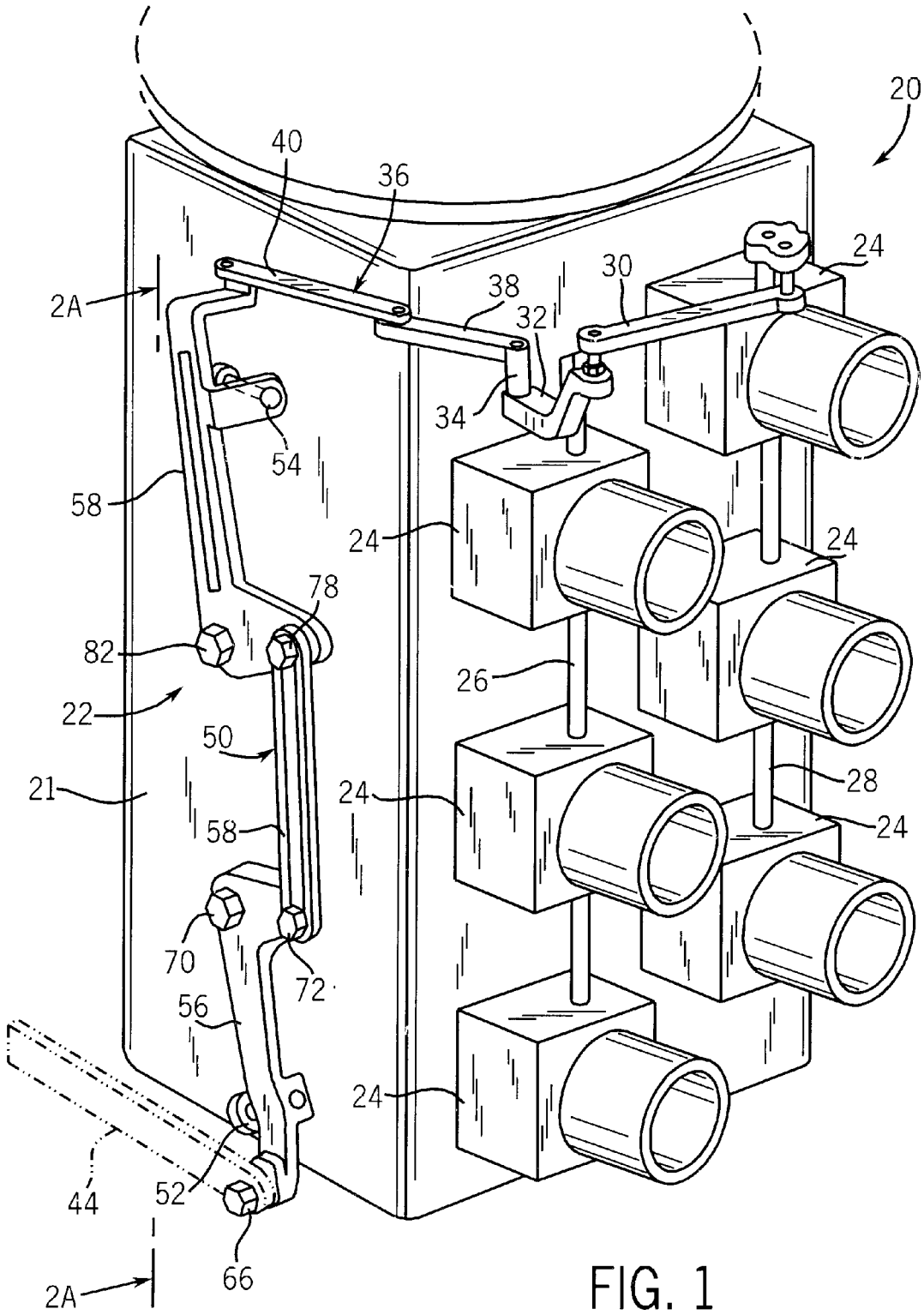
FIG. 1 is a partially schematic perspective view of an outboard marine engine employing a throttle linkage constructed in accordance with a preferred embodiment of the present invention.

Referring to FIG. 1, an engine 20 employs a throttle linkage 22 constructed in accordance with a preferred embodiment of the invention. While the illustrated engine 20 is a vertically oriented, fuel injected, six cylinder outboard marine engine, the invention is equally applicable to a variety of other fuel injected and even carbureted engines. The engine 20 includes a vertically extending engine block and crankcase assembly 21 positioned adjacent the transom of a boat (not shown). The throttle linkage 22 is mounted on a side of the engine 20, and six throttle bodies 24 are mounted on a front surface of the engine 20. A separate throttle assembly including a throttle plate (not shown) is provided for controlling airflow to and possibly ignition advance for each throttle body 24. The throttle plates of each row of throttle bodies 24 are connected to one another by a common throttle shaft 26, 28, and both throttle shafts 26 and 28 are connected to one another by a link 30 so as to rotate together. The link 30 is pivoted by a cam follower 32 upon movement of a throttle cam 38. The cam roller 34 is mounted on a cam follower 32. The cam follower 32 is actuated by the throttle cam 38 when the cam 38 is set in motion from the output link 40 from the throttle linkage 22. A second link or output rod 40 of the assembly 36 is coupled to the throttle linkage 22 as detailed below. The input end of the throttle linkage 22 is operatively coupled to an operator-actuated throttle command element (not shown), such as a lever or a twist grip, via an input element. The input element includes a rod 44 and may additionally include other components such as a push-pull cable.

Referring now to FIGS. 2*a*, 2*b*, and 3, the throttle linkage 22 includes a lever assembly 50 mounted on the side of the engine 20 and stop pins 52, 54 mounted on the lever assembly 50. The lever assembly 50 may take many forms so long as swinging movement of its input end is translated into swinging movement of its output end to effect throttle control upon command. The major components of the illustrated lever assembly 50 include a pair of throttle levers 56 and 58 connected to one another by a link 60. Because the outboard marine engine 20 of FIG. 1 extends vertically, the throttle levers 56 and 58 and the link 60 also extend vertically and, accordingly, will hereafter be referred to as a lower throttle lever, an upper throttle lever, and a vertical link, respectively, for the sake of convenience. It should be understood, however, that these orientations, as well as the orientations of other components used in this and other lever assemblies constructed in accordance with the invention, could vary.

Figure 6:
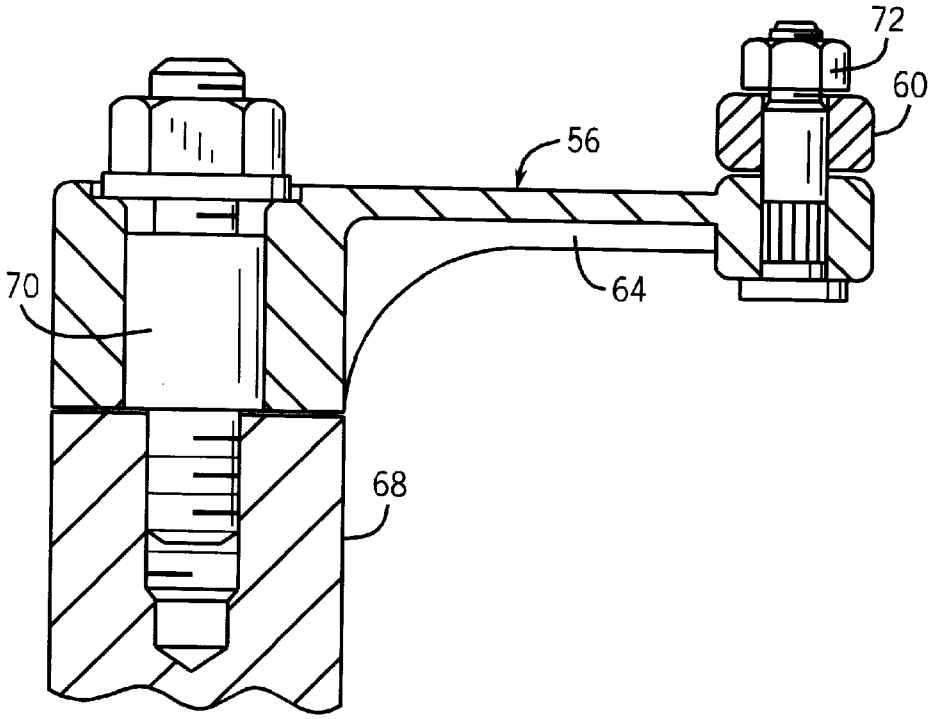
FIG. 6 is a fragmentary sectional view taken generally along the lines 6—6 in FIG. 2*a;*

Still referring to FIGS. 2*a*, 2*b* and 3, the lower throttle lever 56 includes a generally vertical, relatively long leg 62 and a generally horizontal, relatively short leg 64 extending at least generally at a right angle from the relatively long leg 62. A lower input end of the relatively long leg 62 is pivotally coupled to the input rod 44 via a pivot pin and lock nut arrangement 66 as illustrated in FIG. 4. An elbow joining the legs 62 and 64 is pivotally mounted on a tapped boss 68 on the side of the engine 20 by a stud and lock nut arrangement 70 illustrated in FIG. 6. The short leg 64 extends inwardly from the elbow and terminates in an output end that is pivotally coupled to the vertical link 60 by a pivot pin and lock nut arrangement 72 as seen in FIG. 6.

Figure 7:
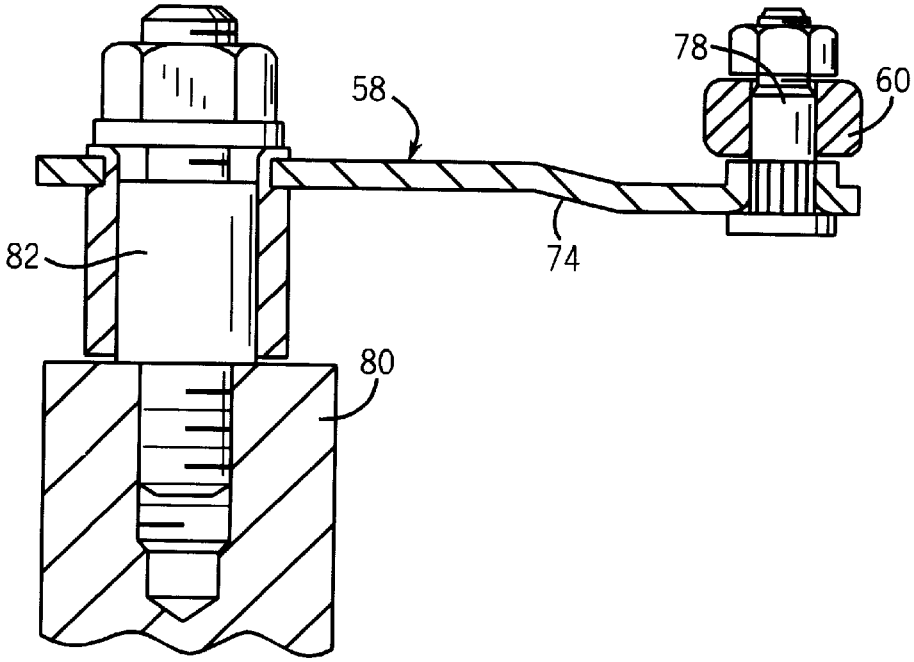
FIG. 7 is a fragmentary sectional view taken generally along the lines 7—7 in FIG. 2*a;*

The upper throttle lever 58 extends in a generally mirror image fashion with respect to the lower throttle lever 56. It includes a generally horizontal, relatively short leg 74 and a generally vertical, relatively long leg 76 extending at least generally at a right angle from the relatively short leg 74. An inner input end of the relatively short leg 74 is pivotally coupled to the vertical link 60 via a pivot pin and lock nut arrangement 78 as illustrated in FIG. 7. An elbow connecting the legs 74 and 76 is pivotally mounted on a tapped boss 80 on the side of the engine 20 by a stud 82 illustrated in FIG. 7. The long leg 76 extends upwardly from the elbow and terminates in an output end that is pivotally coupled to the link 40 of the output element 36 by a ball and socket arrangement 84 as seen in FIG. 9.

The stop pins include a fall-open stop pin 52 and an idler stop pin 54 that are mounted on the lower and upper throttle levers 56 and 58, respectively. In the absence of an operator input command, the throttle stop pin 54 engages a first or upper stationary seat 86 as illustrated in FIG. 2*b*. In a full-open position of the throttle linkage 22, the full-open stop pin 52 engages a second or lower stationary seat 88 to prevent further swinging movement of the lever arm assembly 22. FIG. 2*a*. The first and second stationary seats 86 and 88 may be formed from lugs on the side of the engine 20 or may comprise separate stops or rests mounted on or in the vicinity of the engine 20.

As discussed briefly above, the stop pins 52 and 54 are mounted on the lower and upper throttle levers 56 and 58 so as to be at least axially nonadjustable after they are mounted on the throttle levers and after the throttle linkage 22 is mounted on the engine 20 ("axially nonadjustable" meaning that the spacing between the portion of the stop pin which engages the associated stationary seat and the associated throttle lever cannot be varied, or at least cannot be varied easily without special tools when the throttle linkage 22 is mounted on the engine 20). Several suitable stop pin mounting techniques are available. The most beneficial mounting technique for a particular application will vary with throttle lever construction and stop pin construction. In the illustrated embodiment, the idle stop pin 54 is swaged onto the upper throttle lever 58, and the full-open stop pin 52 is screwed into the lower throttle lever 56.

Specifically, as best seen in FIGS. 3 and 8, a tab 90 extends laterally inwardly from a front surface of the upper throttle lever 58 in alignment with the first stationary seat 86. The associated idle stop pin 54 includes a rear head 92 forming a stop surface of the pin 54, a front head 94, and an annular shoulder 96 spaced from the front head 94 by a distance essentially equal to the thickness of the tab 90 to form a neck 98. The neck 98 is swaged into a slot 100 in the tab 90 (FIG. 3) so as to fix the idle stop pin 54 to the tab 90 and to prevent axial movement of the idle stop pin 54 relative to the tab 90, hence nonadjustably mounting the idle stop pin 54 on the upper throttle lever 58. A first cap 102 is mounted over the rear head 92 of the stop pin 54 for reasons detailed below.

The full-open stop pin 52 is screwed into the lower throttle lever 56 so as to provide a more robust attachment than that provided by the tab 90 and swage-fit arrangement discussed above in connection with the idle stop pin 54. Specifically referring to FIGS. 3 and 5, a lug 104 is formed with, welded to, or otherwise provided on the rear surface of the lower throttle lever 56 in alignment with the second stationary seat 88. The stop pin 52 includes an outer head 106 and an inner, threaded end 108 that is screwed into a tapped bore 110 in the lug 104 as illustrated in FIG. 5. The outer end of the head 106 is slotted to receive a tool such as the head of a flat head screwdriver. Proper axial positioning of the head 106 relative to the throttle lever 56 is assured by dimensioning the threads on the inner end 108 so that a shoulder 112 on the stop pin 52 engages the lug 104 before the threads on the inner end 108 bottom out in the tapped bore 110, thereby setting the final or axially-locked position of the stop pin 52 as one in which the shoulder 112 is tightened against the lug 104. A second cap 114 covers the head 106 of the full-open stop pin 52 for reasons detailed below.

The nonadjustable throttle linkage 22 is assembled and mounted on the engine 20 in the following sequence.

First, the lever assembly 50 is assembled and the stop pins 52 and 54 are mounted on the lever assembly 50. Specifically, the vertical link 60 is connected to the ends of the lower and upper throttle levers 56 and 58 using the connectors 72 and 78. The stop pins 52 and 54 are threaded into and swaged onto the lower and upper throttle levers 56 and 58, either before or after this connection, to axially lock the stop pins 52 and 54 to the throttle levers 56 and 58. Undesired unscrewing of the full-open stop pin 52 relative to the associated lower throttle lever 56 may, if desired, be additionally hindered by applying a chemical locking agent to the threads of the stop pin 52. The caps 92 and 114 are then mounted over the heads 102 and 106 of the stop pins 54 and 52. The caps 92 and 114 serve as cushioned surfaces for abutting the associated stationary seats 86 and 88. The cap 114 for the full-open stop pin 52 also hides the slot in the head 106 of the stop pin from view, thereby discouraging tampering with the stop pin 52.

Next, the throttle linkage 22 is positioned on the engine 20 and bolted to the tapped bosses 68 and 80 on the engine 20 using the connectors 70 and 82 as illustrated in FIGS. 6 and 7. The input end of the lower throttle lever 56 and the output end of the upper throttle lever 58 are also connected to the input and output rods 44 and 40 at this time, using the connectors 66 and 84. After this assembly is complete, the head 114 of the fall-open stop pin 52 faces and is positioned adjacent to the second stationery seat 88, thereby preventing or at least hindering access to the head 114 by a screwdriver or other tool and further hindering tampering with the full-open stop pin 52.

Many changes and modifications may be made to the invention without departing from the spirit thereof. Some of these changes are discussed above. The scope of other changes will become apparent from the appended claims.

We claim:

1. A throttle linkage for an internal combustion engine comprising:

(A) a lever assembly having 1) an input end configured for connection to an input element that is responsive to an operator-imposed throttle command and 2) an output end configured for connection to an output element that controls at least a throttle of the engine; and (B) at least one stop pin mounted on the lever assembly and configured to abut a stationary seat when the lever assembly is in one of a fall-open position thereof and an idle position thereof, wherein the stop pin is mounted on the lever assembly so as to be axially non-adjustable relative to the lever assembly.

2. A throttle linkage as in claim 1, wherein the lever assembly includes at least first and second throttle levers and first and second stop pins, each of which is axially non-adjustably mounted on an associated one of the first and second throttle levers and which selectively engages an associated stationary seat.

3. A throttle linkage as in claim 2, wherein the first throttle lever is configured for connection to the input element, the second throttle lever is configured for connection to the output element, the first stop pin engages the associated stationary seat when the lever assembly is in the full-open position thereof, and the second stop pin engages the associated stationary seat when the lever assembly is in the idle position thereof.

4. A throttle linkage as in claim 2, further comprising a link pivotally connecting the first and second throttle levers to one another.

5. A throttle linkage as in claim 4, wherein one of the first and second stop pins is screwed into the associated throttle lever, and the other of the first and second stop pins is swaged onto the associated throttle lever.

6. A throttle linkage as in claim 5, wherein the first throttle lever is generally L-shaped and has 1) a relatively long leg having a free end thereof configured for connection to the input element, and 2) a relatively short leg extending at least generally at a right angle from the relatively long leg and having a free end pivotally connected to the link.

7. A throttle linkage as in claim 5, wherein the second throttle lever is generally L-shaped and has 1) a relatively short leg having a free end pivotally connected to the link and having a second end, and 2) a relatively long leg extending at least generally at a right angle from the relatively short leg and having a free end configured for connection to the output element.

8. A throttle linkage as into claim 1, wherein the stop pin is screwed into the lever assembly from a side of the lever assembly which faces the stationary seat.

9. A throttle linkage as in claim 8, wherein the stop pin is screwed into a tapped lug disposed on the lever assembly, and wherein a shoulder on the stop pin is locked against the tapped lug to prevent axial movement of the stop pin with respect to the lever assembly.

10. A throttle linkage as in claim 8, further comprising a cap which covers a head of the stop pin to prohibit access to the head of the stop pin by a tool.

11. A throttle linkage as in claim 1, wherein the stop pin is swaged onto the lever assembly so as to prevent axial movement of the stop pin with respect to the lever assembly.

12. A throttle linkage as in claim 11, wherein the stop pin is swaged onto a tab extending laterally from a body of a throttle lever of the lever assembly.

13. A throttle linkage as in claim 11, further comprising a cap which covers a head of the stop pin.

14. A throttle linkage as in claim 1, wherein the throttle linkage is configured for use on a fuel-injected outboard marine engine.

15. A throttle linkage for an outboard marine engine comprising:

(A) a lower throttle lever having an input end configured for connection to an input element for the throttle linkage and having an output end;

(B) a vertical link having an input end pivotally connected to the upper end of the lower throttle lever and having an output end;

(C) an upper throttle lever having an input end pivotally connected to the output end of the vertical link and having an output end configured for connection to an output element for the throttle linkage;

(D) a first stop pin mounted on the upper throttle lever and being configured to engage a first stationary seat when the throttle linkage is in one of an idle position thereof and a full-open position thereof; and (E) a second stop pin mounted on the lower throttle lever and being configured to engage a second stationary seat when the throttle linkage is in a the other of the idle position thereof and the full-open position thereof, wherein each of the first and second stop pins is mounted on the associated throttle lever so as to be axially nonadjustable relative to the associated throttle lever.

16. A throttle linkage as in claim 15, wherein the second stop pin is screwed into the lower throttle lever.

17. A throttle linkage as in claim 15, wherein the second stop pin is screwed into the lower throttle lever from a side of the throttle linkage which faces the second stationary seat.

18. A throttle linkage as in claim 17, further comprising a cap which covers a head of the second stop pin to prohibit access to the head of the second stop pin by a tool.

19. A throttle linkage as in claim 11, and wherein the second stop pin is swaged onto the upper throttle lever.

20. An internal combustion engine comprising:

(A) an engine;

(B) at least one throttle body that is mounted on the engine;

(C) a throttle that controls airflow to the throttle body;

(D) an input element that is responsive to an operator-imposed throttle command;

(E) an output element that is operatively coupled to the throttle; and (F) a throttle linkage that is mounted on the engine and that couples the input element to the output element, the throttle linkage comprising (1) a lever assembly having a) an input end connected to the input element and b) an output end connected to the output element, and (2) at least one stop pin mounted on the lever assembly and configured to abut a stationary seat on the engine when the lever assembly is in one of a full-open position thereof and an idle position thereof, wherein the stop pin is mounted on the lever assembly so as to be axially non-adjustable relative to the lever assembly.

21. An engine as in claim 20, wherein the lever assembly includes at least first and second throttle levers and first and second stop pins, each of which is axially non-adjustably mounted on an associated one of the first and second throttle levers and which selectively engages an associated stationary sat, and wherein the first stop pin engages the associated stationary seat when the lever assembly is in an idle position thereof and the second stop pin engages the associated stationary seat when the lever assembly is in a full-open position thereof.

22. An engine as in claim 21, further comprising a link pivotally connecting the first and second throttle levers to one another.

23. An engine as into claim 20, wherein the stop pin is screwed into the lever assembly from a side of the lever assembly which faces the stationary seat.

24. An engine as in claim 23, further comprising a cap which covers a head of the stop pin to prohibit access to the head of the stop pin by a tool.

25. An engine as in claim 20, wherein the stop pin is swaged onto the lever assembly so as to prevent axial movement of the stop pin with respect to the lever assembly.

26. An engine as in claim 20, wherein said engine has multiple cylinders, each of which has a dedicated throttle body, and wherein said output element encloses a drive rod, a cam coupled to the drive rod, and at least one rotatable throttle shaft coupling the cam to the throttles of more than one throttle body.

27. An engine as in claim 20, wherein said engine is an outboard marine engine.

28. A method of mounting a throttle linkage on an internal combustion engine, comprising:

(A) mounting a stop pin on a lever assembly so as to prevent subsequent axial adjustment of the stop pin relative to the lever assembly;

(B) mounting the lever assembly on the engine such that the stop pin faces and is disposed adjacent to a stationary seat;

(C) connecting an input end of the lever assembly to an input element that is responsive to an operator-imposed throttle command; and (D) connecting an output end of the lever assembly to an output element that is operatively coupled to a throttle of the engine.

29. A method as in claim 28, wherein the step of mounting the stop pin comprises screwing the stop pin into a threaded component of the lever assembly by turning a head of the stop pin using a tool, and wherein, after the lever assembly is mounted on the engine, the head of the stop pin faces and is disposed adjacent to the stationary seat and is inaccessible to the tool.

30. A method as in claim 29, further comprising covering the head of the stop pin with a cap that prevents access to the head by the tool.

31. A method as in claim 28, wherein the step of mounting the stop pin on the lever assembly comprises swaging the stop pin onto the lever assembly.

32. A method as in claim 28, wherein the lever assembly comprises lower and upper throttle levers coupled to one another by a vertical link, and wherein the step of mounting the stop pin comprises mounting, a first stop pin on the lower throttle lever and a second stop pin on the upper throttle lever, and wherein, following the step of mounting the lever assembly on the engine, the first stop pin faces a first stationary seat and engages the first stationary seat when the lever assembly is in one of an idle position thereof and a full-open position thereof and the second stop pin faces a second stationary seat and engages the second stationary seat when the lever assembly is in the other of the idle position thereof and the full-open position thereof.

33. A throttle linkage for an internal combustion engine comprising:

(A) a lever assembly having 1) an input end having means for connection to an input element that is responsive to an operator-imposed throttle command and 2) an output end having means for connection to an output element that controls at least a throttle of the engine;

(B) at least one stop pin mounted on the lever assembly and configured to abut a stationary seat when the lever assembly is in one of a full-open position thereof and an idle position thereof; and (C) means for locking the stop pin to the lever assembly so as to be axially non-adjustable relative to the lever assembly.

34. A throttle linkage as in clam 33, wherein said means for locking comprises a swaged connection between said stop pin and said lever assembly.

35. A throttle linkage as in claim 33, wherein said means for locking comprises a locked threaded connection between said stop pin and said lever assembly.

36. A throttle linkage as in claim 35, wherein said means for locking further comprises a cap which covers a head of said stop pin.

* * * * *

UNITED STATES PATENT AND TRADEMARK OFFICE

CERTIFICATE OF CORRECTION

PATENT NO. : 6,484,706 B1
DATED : November 26, 2002
INVENTOR(S) : Mate, David W.

It is certified that error appears in the above-identified patent and that said Letters Patent is hereby corrected as shown below:

Column 1,
Line 34, delete “fall” and substitute therefor -- full --.

Column 2,
Line 27, delete “fall” and substitute therefor -- full --; and

Column 6,
Line 56, delete “fall” and substitute therefor -- full --.

Signed and Sealed this

Fourth Day of March, 2003

JAMES E. ROGAN
*Director of the United States Patent and Trademark Office*